US009023467B2

(12) United States Patent
Nishida et al.

(10) Patent No.: US 9,023,467 B2
(45) Date of Patent: May 5, 2015

(54) SURFACE-COATED WC-BASED CEMENTED CARBIDE INSERT

(75) Inventors: Shin Nishida, Joso (JP); Takeshi Ishii, Joso (JP)

(73) Assignee: Mitsubishi Materials Corporation, Tokyo (JP)

( * ) Notice: Subject to any disclaimer, the term of this patent is extended or adjusted under 35 U.S.C. 154(b) by 81 days.

(21) Appl. No.: 13/822,101

(22) PCT Filed: Sep. 7, 2011

(86) PCT No.: PCT/JP2011/070346

§ 371 (c)(1),
(2), (4) Date: Mar. 11, 2013

(87) PCT Pub. No.: WO2012/036037

PCT Pub. Date: Mar. 22, 2012

(65) Prior Publication Data

US 2013/0177776 A1 Jul. 11, 2013

(30) Foreign Application Priority Data

Sep. 15, 2010 (JP) ..... 2010-206501

(51) Int. Cl.
*C22C 29/00* (2006.01)
*B26D 1/00* (2006.01)
(Continued)

(52) U.S. Cl.
CPC ..... *B26D 1/0006* (2013.01); *C22C 29/08* (2013.01); *C23C 30/005* (2013.01); *C22C 29/02* (2013.01); *B22F 2207/01* (2013.01)

(58) Field of Classification Search
CPC ..... B26D 1/0006
USPC ..... 51/307, 309; 428/336, 457, 469, 472, 428/697, 698, 699; 407/119; 75/240, 241
See application file for complete search history.

(56) References Cited

U.S. PATENT DOCUMENTS 4,282,289 A * 8/1981 Kullander et al. ..... 428/698
4,399,168 A * 8/1983 Kullander et al. ..... 428/698
(Continued)

FOREIGN PATENT DOCUMENTS

JP 2003-113437 A 4/2003
JP 2003-205406 A 7/2003
(Continued)

OTHER PUBLICATIONS

International Search Report dated Nov. 1, 2011, issued for PCT/JP2011/070346.

*Primary Examiner* — Archene Turner
(74) *Attorney, Agent, or Firm* — Locke Lord LLP

(57) ABSTRACT

Provided is a surface-coated cemented carbide insert obtained by containing at least WC powder and Co powder as raw materials, including a WC-based cemented carbide obtained by forming and sintering mixed raw materials containing at least any of (a) Zr compound powder, Nb compound powder, and Ta compound powder, (b) complex compound powder of Nb and Ta, and Zr compound powder, (c) complex compound powder of Nb, Ta, and Zr, (d) complex compound powder of Nb, Zr, and Ta compound powder, and (e) complex compound powder of Ta and Zr, and Nb compound powder, as essential powder components, as a substrate, and forming a hard coating layer on the substrate by vapor deposition, in which a Co enrichment surface region is formed in a substrate surface, Co content in the Co enrichment surface region satisfies to be between 1.30 and 2.10 (mass ratio) of Co content in cemented carbide.

1 Claim, 1 Drawing Sheet

(51) Int. Cl.

| | |
|---|---|
| ***C22C 29/08*** | (2006.01) |
| ***C23C 30/00*** | (2006.01) |
| ***C22C 29/02*** | (2006.01) |

(56) References Cited

U.S. PATENT DOCUMENTS

| | | | | | |
|---|---|---|---|---|---|
| 4,610,931 | A | * | 9/1986 | Nemeth et al. | 75/240 |
| 4,828,612 | A | * | 5/1989 | Yohe | 75/241 |
| 5,250,367 | A | * | 10/1993 | Santhanam et al. | 428/698 |
| 5,705,263 | A | * | 1/1998 | Lenander et al. | 428/699 |
| 5,955,186 | A | * | 9/1999 | Grab | 428/472 |
| 6,217,992 | B1 | * | 4/2001 | Grab | 428/336 |
| 6,554,548 | B1 | * | 4/2003 | Grab et al. | 407/119 |
| 6,638,474 | B2 | * | 10/2003 | Liu et al. | 419/14 |
| 7,384,689 | B2 | * | 6/2008 | Mikus | 75/240 |
| 2003/0115984 | A1 | | 6/2003 | Zackrisson et al. | |
| 2004/0214050 | A1 | | 10/2004 | Zackrisson et al. | |

FOREIGN PATENT DOCUMENTS

| | | | |
|---|---|---|---|
| JP | 2005-206912 | A | 8/2005 |
| JP | 2005-248265 | A | 9/2005 |
| JP | 2005-248309 | A | 9/2005 |

* cited by examiner

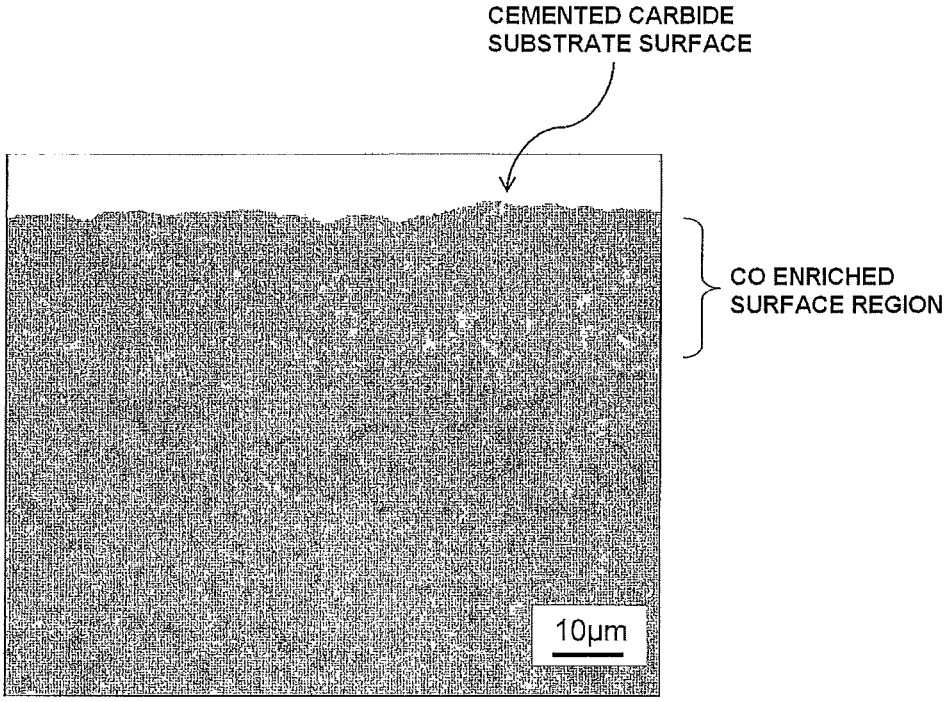
CEMENTED CARBIDE
SUBSTRATE SURFACE
CO ENRICHED
SURFACE REGION
10μm

SURFACE-COATED WC-BASED CEMENTED CARBIDE INSERT

TECHNICAL FIELD

The present invention relates to a surface-coated WC-based cemented carbide insert (hereinafter, referred to as a coated carbide insert) which shows excellent chipping resistance and thermoplastic deformation resistance of a hard coating layer and exhibits excellent wear resistance over long-term use, in an interrupted heavy cutting process of steel or cast iron in which an impulsive and intermittent high load acts on a cutting edge.

BACKGROUND ART

In the related art, for example, as disclosed in Patent Citation 1, as a tool for a cutting process of steel or cast iron, a cemented carbide tool in which plastic deformation of a cutting edge at the time of a heavy cutting process at which a cutting edge temperature is high is prevented and improvement of wear resistance is realized, by containing a hard phase of carbide such as Zr and Hf as components of cemented carbide, has been known, and also, a surface-coated carbide insert (called a coated carbide insert 1 of the related art) in which a hard coating layer is formed on a cemented carbide substrate, has been widely known.

In addition, for example, as disclosed in Patent Citation 2, a coated carbide insert (called a coated carbide insert 2 of the related art) having cemented carbide as a substrate, which contains 4% to 12% of Co, 0.3% or more of Ti, 0.5% or more of Nb, and less than 0.3% of Ta as components of cemented carbide all in weight ratio, and in which a Co enrichment region having a Co enrichment ratio of 1.20 to 3.00 and a thickness of 10 μm to 50 μm is formed in a cemented carbide surface, and cubic carbide is not included in the Co enrichment region, however, a large amount of cubic carbide is included in a lower portion of the Co enrichment region, has been known, and it has been known that the coated carbide insert 2 of the related art has high strength of the cutting edge and excellent resistance to thermal shock.

[Patent Citation 1] JP-A-2003-113437

[Patent Citation 2] JP-A-2003-205406

DISCLOSURE OF INVENTION

Technical Problem

The performance of machine tools in recent years is excellent, and meanwhile, there are strong demands for power saving, energy saving, and low cost with respect to the cutting process, and accordingly, the cutting process tends to have a high speed and a high efficiency more and more. In the coated carbide inserts 1 and 2 of the related art, there is no particular problem, in a case of using in the cutting process under normal conditions, however, for example, in a case of using in an interrupted heavy cutting process in which an impulsive and intermittent high load acts on a cutting edge, the tool life ends in a relatively short time due to chipping and uneven wear progress.

For example, in the coated carbide insert 1 of the related art, the chipping or fracturing easily occurs due to insufficient toughness of the cutting edge, and in the coated carbide insert 2 of the related art, the uneven wear progress easily occurs due to insufficient thermoplastic deformation resistance of the cutting edge, and accordingly, there is problem of a short tool life. Thus, it is required to develop a surface-coated WC-based cemented carbide insert (coated carbide insert) which has excellent chipping resistance and thermoplastic deformation resistance and exhibits excellent wear resistance over long-term use, even in an interrupted heavy cutting process of steel or cast iron in which an impulsive and intermittent high load acts on a cutting edge.

Technical Solution

For solving the problems described above, the present inventors acquired the following findings described below, by investigating components of a substrate formed of the WC-based cemented carbide and sintering conditions.

That is, the WC-based cemented carbide insert of the related art (for example, the coated carbide inserts 1 and 2 of the related art) is generally obtained by compounding WC powder, Co powder, TiC powder, TiN powder, TaC powder, NbC powder which have predetermined each particle size with a predetermined ratio as base powder, further mixing a binder and a solvent thereto, after drying, press-forming in a green compact having a predetermined shape with predetermined pressure, sintering the green compact with predetermined sintering conditions to manufacture a material of a WC-based cemented carbide insert, and grinding and processing to a predetermined insert shape and to a honing amount.

In the manufacturing method of the WC-based cemented carbide insert of the related art, as an essential powder component, at least any of (a) Zr compound powder, Nb compound powder, and Ta compound powder, (b) complex compound powder of Nb and Ta, and Zr compound powder, (c) complex compound powder of Nb, Ta, and Zr, (d) complex compound powder of Nb and Zr, and Ta compound powder, and (e) complex compound powder of Ta and Zr, and Nb compound powder, are added to WC powder and Co powder having predetermined each particle size as base powder of the WC cemented carbide, and then, a green compact is manufactured by press forming. For example, this is heated to 1300° C. at a temperature rising rate between 2° C./min and 10° C./min with $N_2$ pressure between 0.06 KPa and 2.0 KPa, and then heated to a predetermined temperature between 1400° C. and 1500° C. at a temperature rising rate between 10° C./min and 20° C./min in a $N_2$/Ar mixed atmosphere by substituting 35% of 80% of $N_2$ by Ar while holding the pressure, after that, sintering is performed under conditions of cooling after holding and sintering for 45 minutes, and then, by grinding this, the green compact is processed to a predetermined insert shape and a honing amount. By forming a hard coating layer thereon by performing vapor deposition, the present inventors can obtain a WC cemented carbide insert of the present invention in which a Co enrichment surface region having an average thickness of 5 μm to 35 μm which substantially does not contain Zr is formed in a surface of the WC cemented carbide insert, Co content in the Co enrichment surface region is between 1.30 and 2.10 (herein, in a mass ratio) of Co content in cemented carbide, and total content of Nb and Ta in the Co enrichment surface region is between 0.025 and 0.085 (herein, in a mass ratio) of the Co content in the Co enrichment surface region.

In addition, an example of a picture of a structure of the Co enrichment surface region of the WC-based cemented carbide insert is shown in FIG. 1.

In addition, in the coated carbide insert of the present invention including the Co enrichment surface region including the predetermined Co mass ratio, Nb mass ratio, and Ta mass ratio, since, even in a case of using in the interrupted heavy cutting process of steel or cast iron in which an impulsive and intermittent high load acts on the cutting edge, the cutting edge has both toughness and thermoplastic deformation resistance which can satisfy this case, the excellent chipping resistance and wear resistance are exhibited over long-term use.

The present invention has been made based on the findings described above, and provides a "surface-coated cemented carbide insert which is obtained by containing at least WC powder and Co powder as raw materials, including a WC-based cemented carbide obtained by forming and sintering mixed raw materials containing at least any of (a) Zr compound powder, Nb compound powder, and Ta compound powder, (b) complex compound powder of Nb and Ta, and Zr compound powder, (c) complex compound powder of Nb, Ta, and Zr, (d) complex compound powder of Nb, Zr, and Ta compound powder, and (e) complex compound powder of Ta and Zr, and Nb compound powder, as a substrate, and forming a hard coating layer on the substrate by vapor deposition, wherein a Co enrichment surface region having an average thickness of 5 μm to 35 μm is formed in a substrate surface of the WC-based cemented carbide, Co content in the Co enrichment surface region satisfies to be between 1.30 and 2.10 (herein, in a mass ratio) of Co content in cemented carbide, and total content of Nb and Ta in the Co enrichment surface region is between 0.025 and 0.085 (herein, in a mass ratio) of the Co content in the Co enrichment surface region."

A configuration of the present invention will be described hereinafter.

For example, at least any of (a) Zr compound powder, Nb compound powder, and Ta compound powder, (b) complex compound powder of Nb and Ta, and Zr compound powder, (c) complex compound powder of Nb, Ta, and Zr, (d) complex compound powder of Nb, Zr, and Ta compound powder, and (e) complex compound powder of Ta and Zr, and Nb compound powder are added to WC powder and Co powder having predetermined each particle size as an essential powder component, and after compounding a base powder having a predetermined combination ratio, a binder and a solvent mixed thereto, after drying, press-forming is performed in a green compact having a predetermined shape with predetermined pressure. After that, the green compact is heated to 1200° C. at a temperature rising rate between 2° C./min and 10° C./min with $N_2$ pressure between 0.06 KPa and 2.0 KPa (called primary temperature rising), for example, and then heated to a predetermined temperature between 1400° C. and 1500° C. at a temperature rising rate between 10° C./min and 20° C./min in a $N_2$/Ar mixed atmosphere by substituting 35% of 80% of $N_2$ by Ar while holding the pressure (called secondary temperature rising), after that, sintering is performed under conditions of cooling after holding and sintering for 45 minutes, and then, by grinding this, the green compact is processed to a predetermined insert shape and a honing amount, and thus, the cemented carbide substrate of the coated carbide insert of the present invention is obtained.

It is desirable that the base powder composition satisfies WC:Co:Zr compound:Nb compound:Ta compound=(70.0% to 94.0%):(4.0% to 12.0%):(1.0% to 7.0%):(0.7% to 4.0%):(0.6% to 6.5%), by mass ratio.

Herein, the compound mainly refers to carbide, nitride, carbonitride, or the like, and the complex compound refers to a solid solution compound of Nb, Ta, and Zr.

By performing coating forming of a hard coating layer (TiN layer, TiCN layer, $Al_2O_3$ layer, or the like) which is well known to a person skilled in the art, on the cemented carbide substrate of the present invention which contains the Zr compound, the Nb compound, and the Ta compound obtained with the manufacturing method described above, by chemical vapor deposition, the coated carbide insert of the present invention is manufactured.

When observing the vicinity of the interface of the carbide substrate surface of the obtained coated carbide insert of the present invention and the hard coating layer using an optical microscope, as shown in FIG. 1, it was observed that the Co enrichment surface region having an average thickness of 5 μm to 35 μm is formed in the substrate surface.

The thickness of the Co enrichment surface region to be formed is influenced by temperature, time, pressure, and the like at the time of sintering, however, if the Co enrichment surface region is thinner than 5 μm, improvement of the chipping resistance and the fracturing resistance cannot be expected in the interrupted heavy cutting process, and meanwhile, if the Co enrichment surface region is thicker than 35 μm, the thermoplastic deformation resistance is degraded and the uneven wear progress easily occurs, and thus, the average thickness of the Co enrichment surface region is set between 5 μm and 35 μm.

Next, the Co content, Nb content, and Ta content in the Co enrichment surface region of the WC-based cemented carbide substrate of the coated carbide insert of the present invention, and the WC cemented carbide substrate are measured as follows.

The measurement of the Co content, the Nb content, and the Ta content is performed on a longitudinal section of the WC-based cemented carbide substrate using an electron probe microanalyzer (hereinafter, referred to as an EPMA).

When the measurement is performed, it is found that the Co content in the Co enrichment surface region is between 1.30 and 2.10 of the Co content in the cemented carbide, and the total of the Nb content and the Ta content is between 0.025 and 0.085 (herein, both in a mass ratio) of the Co content in the Co enrichment surface region.

The Co content in the Co enrichment surface region is largely influenced as described below, by the sintering conditions, particularly, by the $N_2$ pressure at the time of the primary temperature rising and a mixing ratio of $N_2$ and Ar in the $N_2$/Ar mixed gas at the time of the secondary temperature rising and the sintering.

If the difference of the $N_2$ pressure at the time of primary temperature rising and $N_2$ partial pressure in the $N_2$/Ar mixed gas at the time of the secondary temperature rising and the sintering is large, the Co content in the Co enrichment surface region relatively becomes high. In contrast, if the difference of the $N_2$ pressure at the time of primary temperature rising and $N_2$ partial pressure in the $N_2$/Ar mixed gas at the time of the secondary temperature rising and the sintering is small, the Co content in the Co enrichment surface region relatively becomes low.

In addition, the Nb content and the Ta content in the Co enrichment surface region is largely influenced as described below, by the sintering conditions, particularly, a temperature rising rate at the time of the secondary temperature rising, in addition to the $N_2$ pressure at the time of the primary temperature rising and a mixing ratio of $N_2$ and Ar in the $N_2$/Ar mixed gas at the time of the secondary temperature rising and the sintering.

If the difference of the $N_2$ pressure at the time of primary temperature rising and $N_2$ partial pressure in the $N_2$/Ar mixed gas at the time of the secondary temperature rising and the sintering is large and the temperature rising rate at the time of secondary temperature rising is high, the Nb content and the Ta content in the Co enrichment surface region relatively become high. In contrast, if the difference of the $N_2$ pressure at the time of primary temperature rising and $N_2$ partial pressure in the $N_2$/Ar mixed gas at the time of the secondary temperature rising and the sintering is small and the temperature rising rate at the time of secondary temperature rising is low, the Nb content and the Ta content in the Co enrichment surface region relatively become low.

If the Co content in the Co enrichment surface region is less than 1.30, the toughness of the Co enrichment surface region is insufficient, and the improvement of the chipping resistance and the fracturing resistance cannot be expected, and on the other hand, if the Co content in the Co enrichment surface region exceeds 2.10, since the thermoplastic deformation resistance of the Co enrichment surface region tends to be degraded, the uneven wear progress easily occurs, and the wear resistance is degraded, and thus, the Co content in the Co enrichment surface region is determined to be between 1.30 and 2.10 (herein, in a mass ratio) of the Co content in the cemented carbide.

Further, the performance of the thermoplastic deformation resistance of the Co enrichment surface region is largely influenced by the Nb component, the Ta component existing in the Co enrichment surface region, and Nb content and the Ta content. That is, if Nb and Ta of 0.025 to 0.085 (herein, in a mass ratio) with respect to the Co content in the Co enrichment surface region exist in the Co enrichment surface region of the carbide substrate after the sintering, the thermoplastic deformation resistance of the Co enrichment surface region is improved. However, when the total content of the Nb content and the Ta content with respect to the Co content in the Co enrichment surface region is less than 0.025, the action of Nb and Ta for the improvement of Co strength is insufficient, and predetermined thermoplastic deformation resistance of the Co enrichment surface region cannot be secured, such that the uneven wear progress easily occurs, and on the other hand, when the total content of the Nb content and the Ta content with respect to the Co content in the Co enrichment surface region exceeds 0.085, since the toughness of the Co enrichment surface region is relatively degraded, the chipping or fracturing easily occur, and thus, the total content of the Nb content and the Ta content in the Co enrichment surface region is determined to be between 0.025 and 0.085 (herein, in a mass ratio) with respect to the Co content in the Co enrichment surface region.

In addition, the Zr compound contained as an essential component of the cemented carbide of the present invention forms a strong skeleton structure of the carbide including WC, and as a result, improves the thermoplastic deformation resistance, however, if a large amount of Zr exists in the Co enrichment surface region, not only the sintering property is degraded, but also the toughness is degraded, and the location where Zr exists easily becomes origination of the chipping.

However, according to the sintering conditions of the cemented carbide of the present invention described above, since the Zr content in the Co enrichment surface region is practically zero, it does not negatively affect the chipping resistance and the thermoplastic deformation resistance.

Advantageous Effects

According to the surface-coated cemented carbide insert of the present invention, particularly, by setting the Co content in the Co enrichment surface region to be between 1.30 and 2.10 (herein, in a mass ratio) of the Co content in the cemented carbide, setting the total content of the Nb content and the Ta content in the Co enrichment surface region to be between 0.025 and 0.085 (herein, in a mass ratio) of the Co content in the Co enrichment surface region, and including both the toughness and the thermoplastic deformation resistance for the Co enrichment surface region, in the interrupted heavy cutting process of steel or cast iron in which the impulsive and intermittent high load acts on the cutting edge, excellent chipping resistance and thermoplastic deformation resistance of the hard coating layer are shown, and as a result, it is possible to exhibit excellent wear resistance over long-term use.

BRIEF DESCRIPTION OF DRAWINGS

FIG. 1 shows a picture of a cross section of carbide substrate surface of a surface-coated cemented carbide insert 5 of the present invention taken by an optical microscope.

BEST MODE FOR CARRYING OUT THE INVENTION

Next, a surface-coated cemented carbide insert of the present invention will be described in detail with examples.

Examples

As base powder, WC powder, Co powder, ZrC powder, ZrCN powder, NbC powder, NbCN powder, TaC powder, TaCN powder, and $Cr_3C_2$ powder all of which have a predetermined average particle size in a range of 0.5 μm to 3 μm were compounded with a ratio shown in Table 1, a binder and a solvent were further added thereto, and they were mixed in acetone for 24 hours by a ball mill, and after drying with reduced pressure, press-formed to a green compact having a predetermined shape with pressure of 100 MPa.

The green compact obtained by the press forming was sintered with sintering conditions shown in Table 2, and coated carbide insert materials 1 to 10 of the present invention were manufactured.

By grinding from these coated carbide insert materials, they were processed to an insert shape and a honing amount based on CNMG 120408 (honing amount of 0.07 mm), and coated carbide insert substrates 1 to 10 of the present invention were manufactured.

Further, various hard coating layers were formed on the surfaces of the coated carbide insert substrates 1 to 10 of the present invention, and surface-coated cemented carbide inserts 1 to 10 of the present invention shown in Table 3 (hereinafter, referred to as Examples 1 to 10) were manufactured.

In the surface-coated cemented carbide inserts 1 to 10 of Examples 1 to 10, a thickness of the Co enrichment surface region of the surface of each carbide insert substrate was acquired by optical microscope observation after mirror-lapping of the carbide inserts in a longitudinal section direction.

In addition, FIG. 1 shows a picture of a cross section of a carbide substrate surface of a surface-coated cemented carbide insert 5 of the present invention taken by an optical microscope.

Further, the Co content, Nb content, Ta content, and Zr content in the surface-coated cemented carbide inserts of Examples 1 to 10 and the Co content, Nb content, Ta content, and Zr content in the Co enrichment surface region were measured by the EPMA on locations of the longitudinal sections of the cemented carbide inserts of the present invention, and various content ratios, that is, (Co content in Co enrichment surface region)/(Co content in cemented carbide), (Nb content in Co enrichment surface region)/(Co content in Co enrichment surface region), (Ta content in Co enrichment surface region)/(Co content in Co enrichment surface region), and ((Nb content in Co enrichment surface region)+(Ta content in Co enrichment surface region))/(Co content in Co enrichment surface region) were acquired.

The results thereof are shown in Table 3.

TABLE 1

| substrate | composition of base material (mass %) | | | | | | | | | | | | |
|---|---|---|---|---|---|---|---|---|---|---|---|---|---|
| type | Co | NbC | NbCN | TaC | TaCN | ZrC | ZrCN | (Nb, Ta)C | (Nb, Ta, Zr)C | (Nb, Zr)C | (Ta, Zr)C | $Cr_3C_2$ | WC |
| A | 4.0 | 0.4 | 0.3 | 0.6 | — | 1.0 | — | — | — | — | — | — | remaining |
| B | 5.0 | — | — | — | 0.2 | — | 3.0 | 4.0 | — | — | — | — | remaining |
| C | 6.0 | 1.8 | 1.0 | — | — | — | — | — | — | — | 4.0 | 0.3 | remaining |
| D | 6.5 | 1.5 | — | 3.0 | 1.0 | 1.0 | 2.0 | — | — | — | — | — | remaining |
| E | 7.0 | 3.0 | — | 1.5 | — | 4.0 | — | — | — | — | — | — | remaining |
| F | 7.5 | 2.0 | 0.5 | 2.0 | 0.5 | 2.0 | 1.5 | — | — | — | — | — | remaining |
| G | 8.0 | — | 3.0 | — | — | — | — | — | 4.0 | — | — | — | remaining |
| H | 9.0 | 3.5 | 0.5 | 2.0 | — | 4.0 | — | — | — | — | — | — | remaining |
| I | 10.0 | — | 0.5 | 5.0 | — | — | — | — | — | 7.5 | — | — | remaining |
| J | 12.0 | 2.0 | 1.0 | 4.0 | 2.5 | 3.8 | 3.2 | — | — | — | — | 0.5 | remaining |

TABLE 2

| | sintering conditions of the present invention | | | | | |
|---|---|---|---|---|---|---|
| | primary temperature rising | | secondary temperature rising | | | |
| sintering condition type | temperature rising rate (° C./min) | $N_2$ pressure at the time of temperature rising (KPa) | temperature rising rate (° C./min) | volume ratio of $N_2$/Ar at the time of temperature rising | volume ratio of $N_2$/Ar at the time of sintering | sintering temperature (° C.) |
| A | 5 | 1.50 | 20 | 50/50 | 50/50 | 1430 |
| B | 10 | 0.06 | 18 | 20/80 | 20/80 | 1400 |
| C | 2 | 1.00 | 15 | 60/40 | 60/40 | 1500 |
| D | 7 | 0.10 | 15 | 25/75 | 25/75 | 1450 |
| E | 2 | 0.13 | 10 | 30/70 | 30/70 | 1400 |
| F | 8 | 0.50 | 15 | 40/60 | 40/60 | 1450 |
| G | 10 | 1.85 | 13 | 35/65 | 35/65 | 1400 |
| H | 5 | 0.70 | 10 | 50/50 | 50/50 | 1500 |
| I | 7.5 | 2.00 | 12 | 65/35 | 65/35 | 1450 |
| J | 10 | 1.35 | 20 | 20/80 | 20/80 | 1430 |

TABLE 3

| | Substrate | Sintering condition | Average thickness of Co enrichment surface region | Average value of content in Co enrichment surface region (mass %) | | | | Average value of content in insert (mass %) | | | |
|---|---|---|---|---|---|---|---|---|---|---|---|
| Type | type | type | (μm) | Co | Nb | Ta | Zr | Co | Nb | Ta | Zr |
| Example 1 | A | A | 16 | 7.23 | 0.051 | 0.13 | 0.00 | 3.97 | 0.589 | 0.563 | 0.884 |
| Example 2 | B | B | 18 | 8.43 | 0.169 | 0.261 | 0.00 | 4.99 | 2.391 | 1.394 | 2.335 |
| Example 3 | C | C | 23 | 12.56 | 0.176 | 0.213 | 0.00 | 5.98 | 2.375 | 0.938 | 2.651 |
| Example 4 | D | D | 5 | 8.42 | 0.093 | 0.623 | 0.00 | 6.48 | 1.328 | 3.688 | 2.44 |
| Example 5 | E | E | 18 | 10.84 | 0.173 | 0.228 | 0.00 | 6.95 | 2.657 | 1.407 | 3.535 |
| Example 6 | F | F | 30 | 13.84 | 0.166 | 0.554 | 0.00 | 7.48 | 2.162 | 2.313 | 2.935 |
| Example 7 | G | G | 35 | 14.14 | 0.198 | 0.212 | 0.00 | 7.99 | 2.787 | 0.938 | 2.209 |
| Example 8 | H | H | 31 | 15.52 | 0.233 | 0.372 | 0.00 | 8.97 | 3.49 | 1.876 | 3.535 |
| Example 9 | I | I | 20 | 16.17 | 0.049 | 0.841 | 0.00 | 9.98 | 0.833 | 4.689 | 6.186 |
| Example 10 | J | J | 28 | 24.16 | 0.217 | 1.595 | 0.00 | 11.96 | 2.553 | 5.937 | 5.848 |

| | ratio of content | | | | hard coating layer | |
|---|---|---|---|---|---|---|
| Type | Co (Note 1) | Nb/Co (Note 2) | Ta/Co (Note 3) | (Nb + Ta)/Co (Note 4) | layer type | layer thickness (μm) |
| Example 1 | 1.82 | 0.007 | 0.018 | 0.025 | TiN/TiCN/$Al_2O_3$ | 18 |
| Example 2 | 1.69 | 0.02 | 0.031 | 0.051 | TiC/TiN/$Al_2O_3$ | 20 |
| Example 3 | 2.10 | 0.014 | 0.017 | 0.031 | TiCN/$Al_2O_3$ | 15 |
| Example 4 | 1.30 | 0.011 | 0.074 | 0.085 | TiC/$Al_2O_3$ | 20 |
| Example 5 | 1.56 | 0.016 | 0.021 | 0.037 | TiCN/$Al_2O_3$/TiCN | 25 |
| Example 6 | 1.85 | 0.012 | 0.040 | 0.052 | TiCN/$Al_2O_3$/TiCN | 25 |
| Example 7 | 1.77 | 0.014 | 0.015 | 0.029 | TiC/$Al_2O_3$/TiN | 20 |
| Example 8 | 1.73 | 0.015 | 0.024 | 0.039 | TiC/$Al_2O_3$/TiN | 20 |

TABLE 3-continued

| | | | | | | |
|---|---|---|---|---|---|---|
| Example 9 | 1.62 | 0.003 | 0.052 | 0.055 | TiCN/$Al_2O_3$/TiC/TiN | 23 |
| Example 10 | 2.02 | 0.009 | 0.066 | 0.075 | TiCN/TiC/$Al_2O_3$/TiN | 25 |

(Note 1)
indicating "(Co content in Co enrichment surface region)/(Co content in cemented carbide)
(Note 2)
indicating "(Nb content in Co enrichment surface region)/(Co content in Co enrichment surface region)
(Note 3)
indicating "(Ta content in Co enrichment surface region)/(Co content in Co enrichment surface region)
(Note 4)
indicating "((Nb content in Co enrichment surface region) + (Ta content in Co enrichment surface region))/(Co content in Co enrichment surface region)

For comparison, as base powder, WC powder, Co powder, ZrC powder, ZrCN powder, NbC powder, NbCN powder, TaC powder, TaCN powder, and $Cr_3C_2$ powder all of which have a predetermined average particle size in a range of 0.5 μm to 3 μm were compounded with a ratio shown in Table 4, a binder and a solvent were further added thereto, and they were mixed in acetone for 24 hours by a ball mill, and after drying with reduced pressure, press-formed to a green compact having a predetermined shape with pressure of 100 MPa. The green compact obtained by the press forming was sintered with sintering conditions shown in Table 5, and coated carbide insert materials 1 to 10 of Comparative Examples were manufactured.

By grinding from these coated carbide insert materials, they were processed to an insert shape and a honing amount based on CNMG 120408 (honing amount of 0.07 mm), and coated carbide insert substrates 1 to 10 of Comparative Examples were manufactured.

Further, various hard coating layers were formed on the surfaces of the coated carbide insert substrates 1 to 10 of Comparative Examples described above, and surface-coated cemented carbide inserts 1 to 10 of Comparative Examples shown in Table 6 (hereinafter, referred to as Comparative Examples 1 to 10) were manufactured.

In the surface-coated cemented carbide inserts 1 to 10 of Comparative Examples 1 to 10, a thickness of the Co enrichment surface region of the surface of each carbide insert substrate was acquired by optical microscope observation after mirror-lapping of the carbide inserts of Comparative Examples described above.

Further, the Co content, Nb content, Ta content, and Zr content in the surface-coated cemented carbide inserts of Comparative Examples 1 to 10 and the Co content, Nb content, Ta content, and Zr content in the Co enrichment surface region were measured by the EPMA on locations of the longitudinal sections of the cemented carbide inserts of Comparative Examples, and various content ratios, that is, (Co content in Co enrichment surface region)/(Co content in cemented carbide), (Nb content in Co enrichment surface region)/(Co content in Co enrichment surface region), (Ta content in Co enrichment surface region)/(Co content in Co enrichment surface region), and ((Nb content in Co enrichment surface region)+(Ta content in Co enrichment surface region))/(Co content in Co enrichment surface region) were acquired.

The results thereof are shown in Table 6.

TABLE 4

| substrate | compositon of base material (mass %) | | | | | | | | | | | | |
|---|---|---|---|---|---|---|---|---|---|---|---|---|---|
| type | Co | NbC | NbCN | TaC | TaCN | ZrC | ZrCN | (Nb, Ta)C | (Nb, Ta, Zr)C | (Nb, Zr)C | (Ta, Zr)C | $Cr_3C_2$ | WC |
| a | 4.0 | — | — | — | — | — | — | — | 2.0 | — | — | — | remaining |
| b | 5.0 | — | 0.3 | — | 0.5 | — | 3.0 | — | — | — | — | — | remaining |
| c | 6.0 | — | — | — | — | 3.0 | — | — | — | — | — | 0.3 | remaining |
| d | 6.5 | 2.5 | 2.5 | 4.0 | 3.0 | 1.0 | 2.0 | — | — | — | — | — | remaining |
| e | 7.0 | — | — | — | — | 4.0 | — | 13.0 | — | — | — | — | remaining |
| f | 7.5 | — | — | — | — | 2.0 | 1.5 | — | — | — | — | — | remaining |
| g | 8.0 | — | 0.5 | 0.3 | 0.2 | 2.5 | — | — | — | — | — | — | remaining |
| h | 9.0 | 4.0 | — | — | — | — | — | — | — | — | 6.0 | — | remaining |
| i | 10.0 | — | — | 3.5 | — | — | — | — | — | 8.5 | — | — | remaining |
| j | 12.0 | 3.5 | 2.5 | 5.0 | 3.0 | 3.8 | 3.2 | — | — | — | — | 0.5 | remaining |

TABLE 5

| | sintering conditions of the present invention | | | | | |
|---|---|---|---|---|---|---|
| | primary temperature rising | | secondary temperature rising | | | |
| sintering condition type | temperature rising rate (° C./min) | $N_2$ pressure at the time of temperature rising (KPa) | temperature rising rate (° C./min) | volume ratio of $N_2$/Ar at the time of temperature | volume ratio of $N_2$/Ar at the time of sintering | sintering temperature (° C.) |
| a | 5 | 1.50 | 5 | 50/50 | 50/50 | 1430 |
| b | 10 | 0.05 | 3 | 65/35 | 65/35 | 1400 |
| c | 2 | 1.00 | 15 | 60/40 | 60/40 | 1500 |
| d | 7 | 2.00 | 20 | 25/75 | 25/75 | 1450 |

TABLE 5-continued

| | sintering conditions of the present invention | | | | | |
|---|---|---|---|---|---|---|
| | primary temperature rising | | | | | |
| | | $N_2$ pressure | secondary temperature rising | | | |
| sintering condition type | temperature rising rate (° C./min) | at the time of temperature rising (KPa) | temperature rising rate (° C./min) | volume ratio of $N_2$/Ar at the time of temperature | volume ratio of $N_2$/Ar at the time of sintering | sintering temperature (° C.) |
| e | 10 | 1.70 | 15 | 20/80 | 20/80 | 1400 |
| f | 8 | 0.08 | 13 | 35/65 | 35/65 | 1450 |
| g | 10 | 1.85 | 2 | 60/40 | 60/40 | 1400 |
| h | 5 | vacuum | 5 | vacuum | vacuum | 1400 |
| i | 7.5 | vacuum | 7.5 | vacuum | vacuum | 1450 |
| j | 10 | 1.35 | 15 | 40/60 | 40/60 | 1430 |

| | Substrate | Sintering condition | Average thickness of Co enrichment surface region | Average value of content in Co enrichment surface region (mass %) | | | | Average value of content in insert (mass %) | | | |
|---|---|---|---|---|---|---|---|---|---|---|---|
| Type | type | type | (μm) | Co | Nb | Ta | Zr | Co | Nb | Ta | Zr |
| Comparative Example 1 | a | a | 13 | 5.40 | 0.024 | 0.051 | 0.00 | 3.97 | 0.441 | 0.462 | 0.881 |
| Comparative Example 2 | b | b | 15 | 6.87 | 0.013 | 0.043 | 0.00 | 4.98 | 0.230 | 0.433 | 2.333 |
| Comparative Example 3 | c | c | 12 | 7.63 | 0 | 0 | 0.00 | 5.96 | 0 | 0 | 2.646 |
| Comparative Example 4 | d | d | 11 | 9.72 | 0.374 | 1.782 | 0.00 | 6.48 | 4.158 | 6.365 | 2.437 |
| Comparative Example 5 | e | e | 16 | 10.59 | 0.385 | 1.949 | 0.00 | 6.97 | 4.423 | 7.498 | 3.531 |
| Comparative Example 6 | f | f | 27 | 9.44 | 0 | 0 | 0.00 | 7.49 | 0 | 0 | 2.932 |
| Comparative Example 7 | g | g | 22 | 11.25 | 0.022 | 0.036 | 0.00 | 7.98 | 0.379 | 0.451 | 2.205 |
| Comparative Example 8 | h | h | 2 | 9.77 | 0.088 | 0.120 | 0.00 | 8.96 | 3.537 | 1.872 | 3.530 |
| Comparative Example 9 | i | i | 3 | 11.17 | 0.045 | 0.198 | 0.00 | 9.97 | 1.319 | 3.276 | 6.182 |
| Comparative Example 10 | j | j | 21 | 18.81 | 0.439 | 1.908 | 0.00 | 11.98 | 5.051 | 7.309 | 5.845 |

| | ratio of content | | | | hard coating layer | |
|---|---|---|---|---|---|---|
| Type | Co (Note 1) | Nb/Co (Note 2) | Ta/Co (Note 3) | (Nb + Ta)/Co (Note 4) | layer type | layer thickness (μm) |
| Comparative Example 1 | 1.36 | 0.004 | 0.009 | 0.014 | TiN/TiCN/$Al_2O_3$ | 18 |
| Comparative Example 2 | 1.38 | 0.002 | 0.006 | 0.008 | TiC/TiN/$Al_2O_3$ | 20 |
| Comparative Example 3 | 1.28 | 0 | 0 | 0 | TiCN/$Al_2O_3$ | 15 |
| Comparative Example 4 | 1.5 | 0.038 | 0.183 | 0.222 | TiC/$Al_2O_3$ | 20 |
| Comparative Example 5 | 1.52 | 0.036 | 0.184 | 0.220 | TiCN/$Al_2O_3$/TiCN | 25 |
| Comparative Example 6 | 1.26 | 0 | 0 | 0 | TiCN/$Al_2O_3$/TiCN | 25 |
| Comparative Example 7 | 1.41 | 0.002 | 0.003 | 0.005 | TiC/$Al_2O_3$/TiN | 20 |
| Comparative Example 8 | 1.09 | 0.009 | 0.012 | 0.021 | TiC/$Al_2O_3$/TiN | 20 |
| Comparative Example 9 | 1.12 | 0.004 | 0.018 | 0.022 | TiCN/$Al_2O_3$/TiC/TiN | 23 |

-continued

| | | | | | | |
|---|---|---|---|---|---|---|
| Comparative Example 10 | 1.57 | 0.023 | 0.101 | 0.125 | TiCN/TiC/$Al_2O_3$/TiN | 25 |

(Note 1)
indicating "(Co content in Co enrichment surface region)/(Co content in cemented carbide)
(Note 2)
indicating "(Nb content in Co enrichment surface region)/(Co content in Co enrichment surface region)
(Note 3)
indicating "(Ta content in Co enrichment surface region)/(Co content in Co enrichment surface region)
(Note 4)
indicating "((Nb content in Co enrichment surface region) + (Ta content in Co enrichment surface region))/(Co content in Co enrichment surface region)

Then, for all of Examples 1 to 10 and Comparative Examples 1 to 10, in a state of being screwed on a tip end of a tool steel-made bite by a fixing jig, a dry high-speed interrupted cutting process test (normal cutting speed is 200 m/min) of carbon steel with conditions (hereinafter, referred to as cutting conditions 1) of a work material of a round bar having two grooved slits of JIS S45C, a cutting speed of 400 m/min, depth of cut of 2.0 mm, and feed rate of 0.30 mm/rev. and a dry interrupted high depth of cut cutting process test (normal depth of cut is 1.5 mm) of alloy steel with conditions (hereinafter, referred to as cutting conditions 2) of a work material of a round bar having two grooved slits of JIS SNCM 439, a cutting speed of 350 m/min, depth of cut of 3.0 mm, and feed rate of 0.25 mm/rev. were performed, and time until flank wear width reaches 0.3 mm was measured.

The results of the cutting process tests were shown in Table 7.

TABLE 7

| | | Time until flank wear reaches 0.3 mm (minute) | | | | Time until flank wear reaches 0.3 mm (minute) | |
|---|---|---|---|---|---|---|---|
| type | | cutting condition 1 | cutting condition 2 | type | | cutting condition 1 | cutting condition 2 |
| Examples | 1 | 16.4 | 17.2 | Comparative Examples | 1 | * 1.5 | * 1.2 |
| | 2 | 15.7 | 16.6 | | 2 | * 2.1 | * 1.6 |
| | 3 | 14.8 | 15.8 | | 3 | * 3.5 | * 2.6 |
| | 4 | 15.3 | 16.2 | | 4 | * 3.0 | * 2.4 |
| | 5 | 14.0 | 14.7 | | 5 | * 2.4 | * 2.0 |
| | 6 | 14.5 | 15.3 | | 6 | 6.8 | 6.1 |
| | 7 | 13.7 | 14.1 | | 7 | 7.2 | 6.8 |
| | 8 | 13.4 | 13.6 | | 8 | 7.6 | 7.2 |
| | 9 | 12.7 | 12.5 | | 9 | 6 | 5.3 |
| | 10 | 13.1 | 12.8 | | 10 | * 5.3 | * 4.6 |

* is cutting time (minutes) until tool life by chipping

From the results in Tables 3, 6, and 7, in the surface-coated cemented carbide inserts of the present invention, particularly, since the Co enrichment surface region in which the mass ratio of the Co content is 1.30 to 2.10 is formed, and the Co enrichment surface region in which the mass ratio of the total content of the Nb content and the Ta content with respect to the Co content in the Co enrichment surface region is 0.025 to 0.085 is formed, in the interrupted heavy cutting process of steel or cast iron in which an intermittent and impulsive high load acts on a cutting edge, excellent chipping resistance and thermoplastic deformation resistance are shown, and as a result, it is possible to exhibit excellent wear resistance over long-term use without fracturing and uneven wear progress. Meanwhile, in the surface-coated cement carbide inserts of Comparative Examples, it is clear that the tool life is short due to chipping or wear resistance decrement.

INDUSTRIAL APPLICABILITY

In a case of use in the interrupted heavy cutting process, the surface-coated cemented carbide insert of the present invention not only maintains excellent cutting performance over a long-term use, but also realizes longer tool life, and further, the surface-coated cemented carbide insert of the present invention can be used as an insert of various work materials in which the chipping resistance, the fracturing resistance, the thermoplastic deformation resistance, and the wear resistance are necessary, and can sufficiently satisfy energy saving and low cost of the cutting process.

The invention claimed is:

1. A surface-coated cemented carbide insert which is obtained by containing at least WC powder and Co powder as raw materials, including a WC-based cemented carbide obtained by forming and sintering mixed raw materials containing at least any of (a) Zr compound powder, Nb compound powder, and Ta compound powder, (b) complex compound powder of Nb and Ta, and Zr compound powder, (c) complex compound powder of Nb, Ta, and Zr, (d) complex compound powder of Nb and Zr, and Ta compound powder, and (e) complex compound powder of Ta and Zr, and Nb compound powder, as a substrate, and forming a hard coating layer on the substrate by vapor deposition, wherein a Co enrichment surface region having an average thickness of 5 μm to 35 μm which substantially does not contain Zr is formed in a substrate surface of the WC-based cemented carbide, Co content in the Co enrichment surface region satisfies to be between 1.30 and 2.10 (herein, in a mass ratio) of Co content in cemented carbide, and total content of Nb and Ta in the Co enrichment surface region is between 0.025 and 0.085 (herein, in a mass ratio) of the Co content in Co enrichment surface region.

* * * * *